US009784275B2

(12) United States Patent
Michal

(10) Patent No.: US 9,784,275 B2
(45) Date of Patent: Oct. 10, 2017

(54) CENTRIFUGAL PUMP

(75) Inventor: Ludwig Michal, Graz (AT)

(73) Assignee: ANDRITZ AG, Graz (AT)

( * ) Notice: Subject to any disclaimer, the term of this patent is extended or adjusted under 35 U.S.C. 154(b) by 1016 days.

(21) Appl. No.: 13/876,383

(22) PCT Filed: Sep. 23, 2011

(86) PCT No.: PCT/AT2011/000391

§ 371 (c)(1),
(2), (4) Date: Sep. 27, 2013

(87) PCT Pub. No.: WO2012/040752

PCT Pub. Date: Apr. 5, 2012

(65) Prior Publication Data

US 2014/0023485 A1 Jan. 23, 2014

(30) Foreign Application Priority Data

Sep. 27, 2010 (AT) ..... A 1613/2010

(51) Int. Cl.
*F04D 7/04* (2006.01)
*F04D 9/00* (2006.01)

(52) U.S. Cl.
CPC ..... *F04D 7/045* (2013.01); *F04D 9/003* (2013.01)

(58) Field of Classification Search
CPC ..... F04D 17/08; F04D 29/22; F04D 29/2238; F04D 29/225; F04D 29/2283; F04D 29/2288; F04D 31/00; F04D 7/045; F04D 9/003
USPC ..... 415/169.1; 417/420, 423.1, 423.13, 417/423.12, 423.14, 423.15
See application file for complete search history.

(56) References Cited

U.S. PATENT DOCUMENTS 4,936,744 A 6/1990 Dosch et al. ..... 415/169.1
5,087,171 A * 2/1992 Dosch ..... D21D 5/26 162/275
5,114,310 A * 5/1992 Haavik ..... F04C 19/00 415/143

(Continued)

FOREIGN PATENT DOCUMENTS

CN 1900530 A 1/2007
CN 103124852 A 5/2013
EP 1 736 218 A1 12/2006

*Primary Examiner* — Richard Edgar
*Assistant Examiner* — Su Htay
(74) *Attorney, Agent, or Firm* — Alix, Yale & Ristas, LLP

(57) ABSTRACT

The invention relates to a centrifugal pump for conveying a gaseous suspension, in particular a fiber pulp suspension, which has a pump impeller (12) with at least one opening (15) in the base plate and ribs (16) on the rear side, where a separator unit (17) is provided consisting of a separator housing (25) with a stationary disc (18) and a disc (22) that rotates together with the pump shaft (21), where the separator unit (17) is arranged in the pump housing adjoining the pump impeller (12) on its rear side when viewing the pump impeller (12) in axial direction and where the separator housing (25) has a gas collecting chamber (31) with a gas discharge pipe (28). It is characterized by the disc (22) that rotates together with the pump shaft (21) having a closed surface (23) without openings. As a result, pulp losses are reduced and the centrifugal pump achieves better stability when pumping a gaseous suspension, particularly a fiber pulp suspension.

21 Claims, 3 Drawing Sheets

(56) References Cited

U.S. PATENT DOCUMENTS

Figure 1:
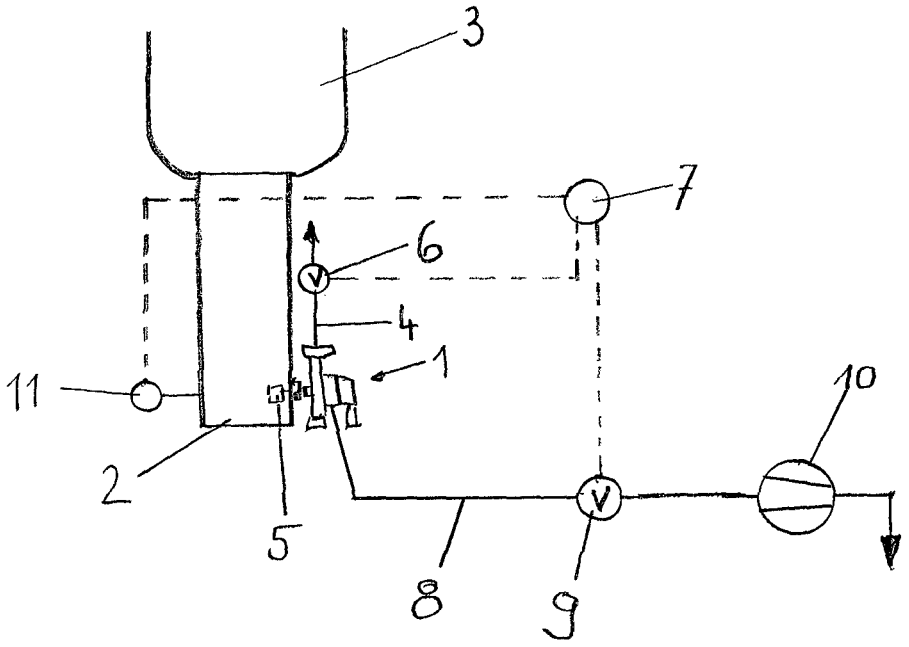

| | | | | | |
|---|---|---|---|---|---|
| 5,116,198 | A * | 5/1992 | Vesala | F04D 7/045 | 415/143 |
| 5,151,010 | A * | 9/1992 | Vesala | F04D 7/045 | 415/143 |
| 5,266,160 | A | 11/1993 | Henricson et al. | 162/57 | |
| 5,462,585 | A * | 10/1995 | Niskanen | B01D 19/0052 | 162/57 |
| 2007/0006559 | A1 * | 1/2007 | Raussi | F04D 9/003 | 55/405 |

* cited by examiner

CENTRIFUGAL PUMP

The invention relates to a centrifugal pump for conveying a gaseous fiber pulp suspension, which has a pump impeller with at least one opening in the base plate and ribs on the rear side, where a separator unit is provided consisting of a separator housing with a stationary disc and a disc that rotates together with the pump shaft, where the separator unit is arranged in the pump housing adjoining the pump impeller on its rear side when viewing the pump impeller in axial direction and where the separator housing has a gas collecting chamber with a gas discharge pipe.

When operating pumps nowadays to pump medium-consistency fiber pulp suspensions, the air must be separated from the pulp in order to guarantee that the pulp can be pumped. This is achieved by the pulp being liquidized first of all by applying shearing forces (either by means of a "liquidizer or fluidizer" mounted on the pump shaft or by an external device ("conditioner")) and by the air being separated from the pulp at the same time. This air is then discharged from the pump with or without the aid of a vacuum pump. Depending on the consistency and/or air content and the pump flow rate, some fibers may be lost in this process through the degassing pipe. In order to resolve this problem or at least alleviate it, relatively complicated control systems are used that are intended to reduce fiber loss. A system of this kind is known from U.S. Pat. No. 5,087,171. In addition, EP 1 736 218 A1 describes a gas separation unit with a rotor. There are also higher fiber losses here due to the fibers being carried into the degassing chamber. In order to limit fiber loss, a compromise is also necessary here with reduced pump capacity. These known systems require a highly complex construction, and considerable effort is also needed to set the control loops, which have to be tuned for different types of pulp from one plant to another. In addition, the existing systems are not reliable enough to prevent fiber loss entirely. In addition to the loss of pulp, fiber losses can also lead to problems with the pump stability.

The aim of the present invention is to eliminate this problem.

The invention is thus characterized by the disc that rotates together with the pump shaft having a closed surface without openings. The advantage of this is that there are practically no more pulp losses, and the pump is also stable. The pulp pressed in the direction of the degassing chamber is conveyed back into the pump by means of the separator impeller and the air can escape from the pump in the opposite direction to the pumping action of the separator.

An advantageous development of the invention is characterized by the stationary disc having ribs (guide vanes), where the stationary disc on the side facing the pump impeller can have a smooth surface with the ribs arranged on the opposite side. The ribs or guide vanes can be arranged radially or also at any desired angle here and have a straight or curved design.

A favorable embodiment of the invention is characterized by the disc that rotates together with the pump shaft having ribs (vanes), where the disc rotating together with the pump shaft can have a smooth surface on the side facing the stationary disc, with the ribs arranged on the opposite side. Here, too, the ribs or guide vanes can be arranged radially or also at any desired angle and can have a straight or curved design. This achieves a further reduction in pulp losses.

An advantageous embodiment of the invention is characterized by an opening for flushing water being provided in the separator housing, where the opening is connected fluidly to the channel formed by the ribs of the rotating disc (together with the separator impeller) and prevents the separator unit from being plugged.

If a fluidizer precedes the pump impeller and is designed as a rotor connected to the pump shaft or can be provided as a rotor arranged separately from the pump shaft, the pulp suspension can be liquidized easily and the air is separated from the pulp. The pulp enters the pump impeller, where by far the greater part of the pulp is pumped into the spiral casing. The part of the pulp mixture (pulp suspension mixed with air) that is pressed through the degassing holes in the pump impeller passes through the degassing holes in the pump impeller and, as a result of backflow in the area behind the pump impeller, into the degassing chamber and the separator area.

Figure 2:
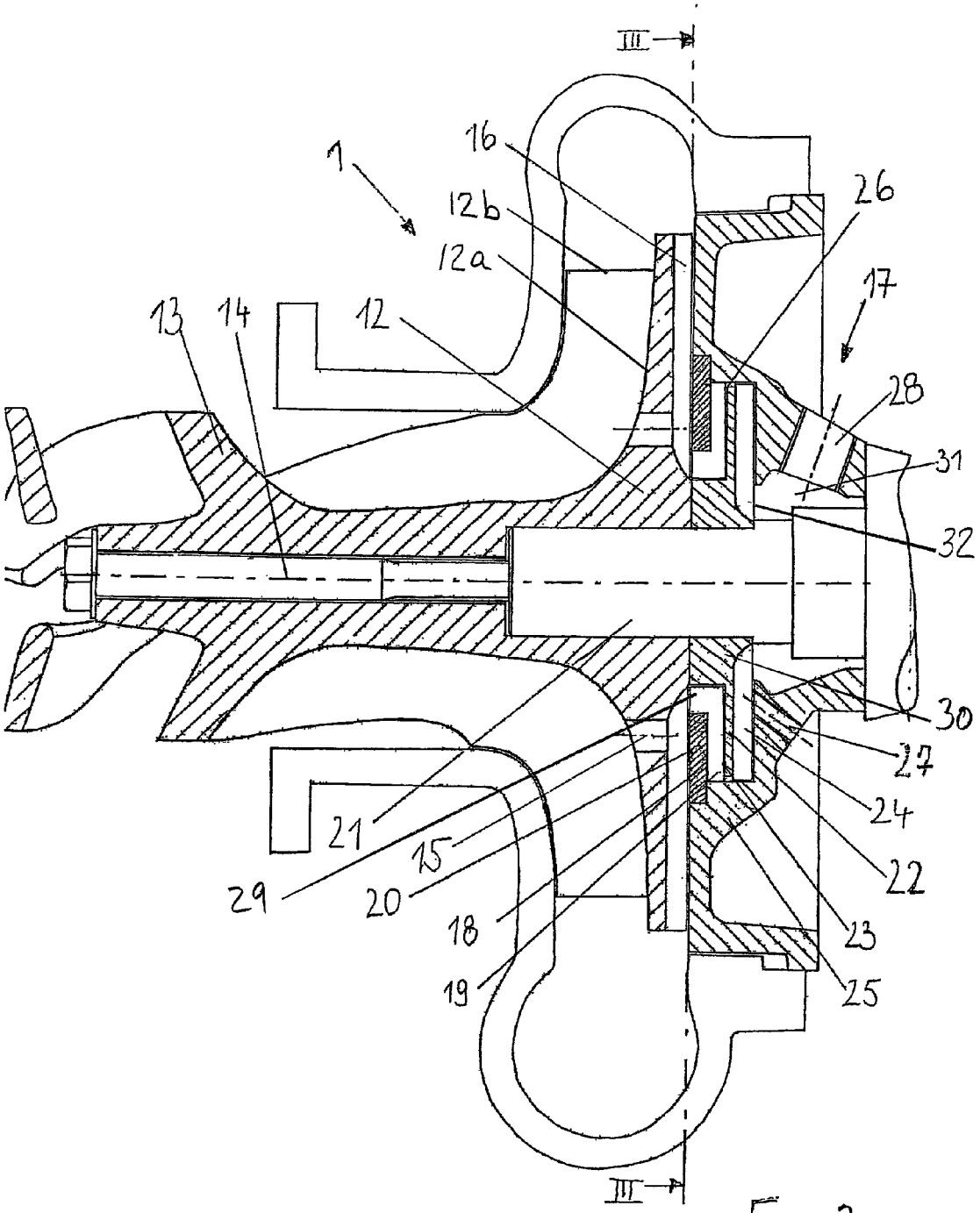
Figure 3:
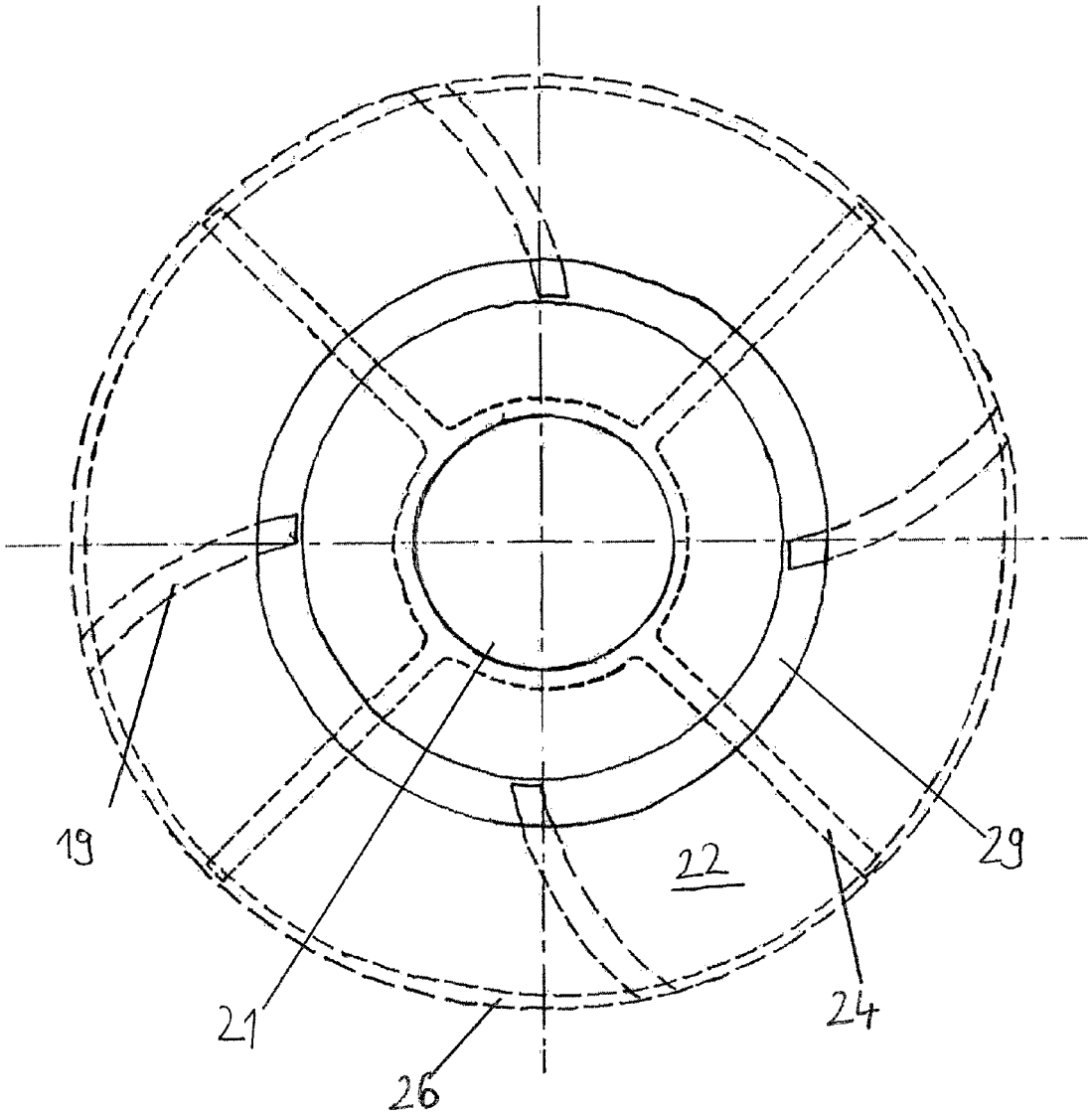

In the following, the invention is described on the basis of the drawings, where FIG. 1 shows a state-of-the-art system for conveying a gaseous suspension, FIG. 2 shows a variant of a centrifugal pump according to the invention, and FIG. 3 shows a sectional view along the line marked in FIG. 2.

FIG. 1 shows a system to convey gaseous suspensions with a state-of-the-art degassing device. The centrifugal pump 1 is mounted here in the lower part of a standpipe 2, which is arranged underneath a large tank 3, e.g. a bleach tower or similar. The pump 1 has a discharge pipe 4 for the medium to be pumped, e.g. a fiber pulp suspension, and at the inlet there is a rotor 5, which is located entirely inside the standpipe 2 and, in combination with the wall of the standpipe 2, is intended to generate turbulence causing the fiber pulp suspension to be fluidized. In the outlet pipe 4, there is a regulating valve 6 that is connected to a control unit 7.

In addition, the pump 1 has a gas discharge pipe 8, in which a regulating valve 9 and a vacuum pump 10 are mounted. The control unit 7 controls the flow in the outlet pipe 4 by means of the control valve 6 and, in particular, by means of the control valve 9 in the gas discharge pipe 8. If the level of the suspension in the tank 3 and standpipe 2, measured by the pressure sensor 11 at the lower end of the standpipe 2, rises too high and there is thus a risk of suspension entering the gas discharge pipe 8, the control unit 7 closes the regulating valve 9. It is this system that largely enables enough gas to be separated when the system is started up and shut down.

FIG. 2 shows a sectional view of a centrifugal pump 1 according to the invention with a pump impeller 12 and fluidizer 13 integrated to it. In the pump impeller 12, there are openings 15 near the axle 14 for discharging gas that has collected on the fluidizer. There are ribs 16 on the rear side of the pump impeller 12. Due to rotation of the pump impeller 12, fibers and liquid are conveyed back into the pump chamber by the ribs 16 in the gas/liquid flow that passes through the openings 15. A separator unit 17 then adjoins the pump impeller. It has a stationary stator plate 18, with stationary vanes or ribs 19, and a smooth surface 20 on the side facing the pump impeller 12, where one or more stationary guide vanes or ribs 19 are arranged on the opposite side and can also be arranged radially or at any desired angle and have a straight or curved design. In addition, the inner diameter of the stator plate 18 is larger than the inner diameter of the ribs 19 of the stationary disc 18 in this area in order to guarantee that there is an open passageway for the air/fiber suspension. Vanes on the stator plate 18 extending almost as far as the outer diameter of the pump shaft can be mounted in this free space. A disc 22 as rotating separator impeller 22 is arranged beside the stator plate 18, connected firmly to the pump shaft or hub 30 and rotating at the same speed. This separator impeller 22 has a smooth surface 23 on the side facing the stator plate 18 and has one or more blades or ribs 24 on the side facing away from the stator plate 18. The rotating disc 22 is smaller in diameter than the inner diameter of the separator housing 25 and forms a gap 26 between its outer circumference and the separator housing 25 to ensure that the air and also the fibers can pass through. This rotating disc 22 has a closed surface without openings. This surface without openings is what makes it possible for pressure to build up inside the separator in the first place. As a result, fiber pulp is largely prevented from escaping into the degassing chamber and the air can escape from the pump in the opposite direction to the pumping action of the separator. In order to prevent the separator unit 17 from plugging, flushing water can be introduced through an opening 27.

In centrifugal pumps for gaseous suspensions, e.g. MC pumps, fiber pulp is pressed through the openings 15 into the degassing chamber or, in the present case, into the separator unit 17 depending on the flow rate and consistency. This pulp is conveyed back into the pump by the separator impeller 22 with the aid of the vanes 24. In operating ranges where no or only a little fiber pulp is pressed into the separator unit 17 or the degassing chamber, more or less air is pressed through the separator unit 17 depending on the volume of air separated. This air is discharged from the pump through a bore hole 28 on the side facing away from the separator impeller 22 with or without the aid of a vacuum pump. Thus, the separator unit 17 according to the invention causes fibers to be pumped back permanently without obstructing the air flowing out at the same time. As the separator impeller 22 has a closed surface without openings, the fibers cannot escape.

The separator housing 25 forms the gas collecting chamber 31 with the pump shaft 21 and contains the gas discharge opening (28) and the pipe 27 for flushing water. The gas that is separated, particularly the air that is separated, flows from the rear side of the pump impeller 12 through the channels formed by the ribs 19 on the stationary disc 18, then passes through the gap 26 into the channels formed by the ribs 24 of the rotating disc 22 into the gas collecting chamber 31 and is discharged from there out of the centrifugal pump 1 through the gas discharge pipe with or also without an additional vacuum pump.

FIG. 3 shows a sectional view of the centrifugal pump according to the invention along the line marked in FIG. 2. The shaft 21 is visible here, as well as the rotating disc 22 with the ribs 24, which are designed here as straight ribs. In addition, the drawing shows the ribs 19 of the stationary disc 18, which are shown here as curved ribs by way of example. However, the ribs 19 of the stationary disc 18 and the ribs 24 of the rotating disc 22 can be either of straight or curved design. In addition, FIG. 3 shows the gap 26 between the rotating disc 22 and the housing 25. Similarly, the annular chamber 29 is shown, located between the stationary disc 18 and the pump shaft 21 and through which the mixture of gas and liquid enters the separator unit 17.

It can thus be appreciated that in the preferred embodiment shown in FIGS. 2 and 3, the centrifugal pump has a rotatable shaft 21 defining a rotation axis, and an impeller 12 having a base plate 12*a* rigidly connected to the shaft and having front and rear sides, and a plurality of blades 12*b* at the front side of the base plate and extending radially outward along the base plate. At least one opening 15 is provided from the front to the rear side of the base plate. A plurality of radially outwardly extending ribs 16 are on the rear side of the base plate. The separator unit includes a stationary housing 25 having a wall with a front side confronting the ribs 16 on the rear side of the base plate. The wall includes a stationary disc or stator plate 18 having a front side and a rear side, with radially outwardly extending ribs 19 on the rear side. A hub 30 for imperforate disc 22 is connected to the shaft for co-rotation therewith. The disc 22 has a front side 23 confronting the ribs on the stator plate 18. A gas collecting chamber 31 is located axially rearward of the disc 22 and has a gas discharge pipe 28. A gas flow path is thereby established from the front of the disc 22 along a radially outer portion of the disc, to the gas collecting chamber 31. As used herein, "radially outwardly" means extending straight or curved in a direction generally away from the center.

An annular chamber 29 is provided between the hub 30 and the stator plate 18, leading to the front side of the disc 22. A gap 26 is provided between the disc 22 and the separator housing 25, and an annular opening 32 is provided between the hub 30 and the separator housing, behind the ribs 24. In this manner, a flow path is defined from the impeller 12 through the openings 15 to a radially inner portion of ribs 16; from the ribs 16 through the annular chamber 29 to the gap 26, and from the gap along the ribs 24, and through the annular opening 32 to the gas collecting chamber 31.

Without the separator unit according to the invention, a compromise is always needed between fiber loss and pump stability, as well as pump performance. By using the separator according to the invention, fiber loss, pump stability, and pump performance can be uncoupled from each another.

The invention claimed is:

1. A centrifugal pump for conveying a gaseous fiber pulp suspension, comprising:

a pump housing;

a rotatable shaft (21) in the pump housing and defining a rotation axis;

an impeller (12) in the pump housing, wherein the impeller has a base plate rigidly connected to the shaft and the base plate has front and rear sides;

at least one opening (15) from the front side to the rear side of the base plate;

a plurality of ribs (16) on the rear side of the base plate;

a separator unit (17) in the pump housing, confronting the ribs (16) on the rear side of the base plate, said separator unit including, a separator housing (25), having a wall with a front side confronting the ribs (16) which are on the rear side of the base plate, said wall including a stator plate (18) with stationary ribs (19);

an imperforate disc (22) firmly connected completely around and rotatable with the shaft, said disc (22) having a front side facing the stator plate (18);

a gas collecting chamber (31) having a gas discharge pipe (28); and a gas flow path from the disc (22), to the gas collecting chamber (31).

2. The pump of claim 1, wherein the stator plate (18) has a front side and a rear side, the front side of the stator plate (18) has a smooth surface (20) and the ribs (19) on the stator plate (18) are on the rear side of the stator plate.

3. The pump of claim 2, wherein the disc (22) that rotates with the shaft (21) has front and rear sides, the front side has a smooth surface (23) and the rear side carries radially outwardly extending ribs (24).

4. The pump of claim 3, wherein the separator housing (25) includes an opening (27) for delivering flushing fluid to the ribs (24) on the rear side of the disc (22) that rotates with the shaft (21).

5. The pump of claim 1, wherein the disc (22) that rotates with the shaft (21) has ribs (24).

6. The pump of claim 1, wherein the disc (22) that rotates with the shaft (21) has front and rear sides, the front side has a smooth surface (23) and the rear side carries radially outwardly extending ribs (24).

7. The pump of claim 6, wherein the separator housing (25) includes an opening (27) for delivering flushing fluid to the ribs (24) on the rear side of the disc (22) that rotates with the shaft (21).

8. The pump of claim 1, wherein a fluidizer (13) is provided in front of the impeller (12).

9. The pump of claim 1, wherein the imperforate disc has a closed surface without any openings.

10. A centrifugal pump for conveying a gaseous fiber pulp suspension, comprising:

a rotatable shaft (21) defining a rotation axis;

an impeller (12) having a base plate rigidly connected to the shaft and the base plate having front and rear sides, and a plurality of blades at the front side of the base plate and extending radially outward along the base plate;

at least one opening (15) from the front to the rear side of the base plate;

a plurality of radially outwardly extending ribs (16) on the rear side of the base plate;

a separator unit (17) confronting the ribs (16) on the rear side of the base plate, said separator unit including;

a stationary separator housing (25), having a wall with a front side confronting the ribs (16) on the rear side of the base plate, said wall including a stator plate (18) having a front side and a rear side, with radially outwardly extending stationary ribs (19) on said rear side;

a hub (30) connected to the shaft for co-rotation therewith and including an imperforate disc (22) firmly connected completely around and extending radially from the hub, said disc (22) having a front side confronting the ribs (19) on the stator plate (18);

a gas collecting chamber (31) located axially rearward of the disc (22) and having a gas discharge pipe (28); and a gas flow path from the front of the disc (22), along a radially outer portion of the disc (22) to the gas collecting chamber (31).

11. The pump of claim 10, wherein the disc (22) has a rear side and a plurality of radially extending ribs (24) are connected to the rear side of the disc.

12. The pump of claim 11, wherein the separator housing includes an opening (27) for delivering flushing fluid to said ribs (24) at the rear side of said disc (22).

13. The pump of claim 11, wherein an annular chamber (29) is provided between the hub (30) and the stator plate (18), leading to the front side of the disc (22);

the disc has a radially outer edge and a gap (26) is provided between the radially outer edge of said disc (22) and the separator housing (25);

an annular opening (32) is provided between the hub (30) and the separator housing, rearward of the ribs (24) at the rear side of said disc (22);

whereby a fluid flow path is defined from the impleller (12)through said at least one opening (15)to said rids (16)on the base plate;

from said ribs (16)on the base plate through said annular chamber (29) to said gap (26); and from said gap along said ribs (24) on the rear side of said disc (22) and through said annular opening (32) to said gas collecting chamber (31).

14. The pump of claim 13 where the impeller (12) is in a pump housing and the separator unit (17) is also in the pump housing.

15. The pump of claim 13, wherein the imperforate disc has a closed surface without any openings.

16. The pump of claim 15, whereby the gas that flows to said gas collection chamber (31) passes radially along the front side of the disc (22) to the radially outer edge of the disk (22), through said gap (26), then radially inward along the rear side of said disc (22) to the gas collecting chamber (31).

17. The pump of claim 16, wherein any pulp present at the rear side of the disc (22) is conveyed through the gap (26) in revere flow relative to the gas, to the front side of the disc (22) and to said annular chamber (29) whereupon said pulp is introduced to the ribs (16) at the rear of the base plate.

18. The pump of claim 10, wherein the front side of the disc (22) has a smooth surface (23).

19. The pump of claim 10, wherein a fluidizer (13) is provided in front of the impeller (12).

20. The pump of claim 19, wherein the fluidizer is a rotor connected to the pump shaft.

21. The pump of claim 10, wherein the imperforate disc has a closed surface without any openings.

* * * * *